US009980511B2

(12) United States Patent
Liu

(10) Patent No.: US 9,980,511 B2
(45) Date of Patent: May 29, 2018

(54) ELECTRONIC CIGARETTE, BATTERY ROD AND ATOMIZER

(71) Applicant: Qiuming Liu, Guangdong (CN)

(72) Inventor: Qiuming Liu, Guangdong (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 835 days.

(21) Appl. No.: 14/504,264

(22) Filed: Oct. 1, 2014

(65) Prior Publication Data

US 2015/0272221 A1 Oct. 1, 2015

Related U.S. Application Data

(63) Continuation of application No. PCT/CN2014/074543, filed on Apr. 1, 2014.

(51) Int. Cl.
*A24F 47/00* (2006.01)

(52) U.S. Cl.
CPC ..... *A24F 47/008* (2013.01)

(58) Field of Classification Search
CPC ..... A24F 47/008
See application file for complete search history.

(56) References Cited

FOREIGN PATENT DOCUMENTS

| | | | |
|---|---|---|---|
| CN | 203388271 | U | 1/2014 |
| CN | 203416808 | U | 2/2014 |
| CN | 203424295 | U | 2/2014 |
| CN | 203435686 | U | 2/2014 |
| WO | 2013149484 | A1 | 10/2013 |

OTHER PUBLICATIONS

International Search Report issued by the State Intellectual Property Office of the P.R. China for PCT/CN2014/074543, dated Jan. 12, 2015.

*Primary Examiner* — Gautam Prakash
(74) *Attorney, Agent, or Firm* — Tim Tingkang Xia, Esq.; Locke Lord LLP

(57) ABSTRACT

The present invention discloses an electronic cigarette, a battery pole and an atomizer. Wherein, the electronic cigarette comprises an atomizer and a battery rod, a first connecting element and a second connecting element; the first connecting element includes a first external electrode, a first internal electrode formed in one piece and an elastic element; the first internal electrode extends through the first external electrode and is electrically insulated from the first external electrode; the elastic element abuts against the first internal electrode and is configured to provide an elastic force that is oriented towards the second connecting element to the first internal electrode; a through-hole is defined in the elastic element; the elastic element is sleeved between the first external electrode and the first internal electrode; and a groove is defined on the peripheral face and/or end face of the elastic element.

6 Claims, 8 Drawing Sheets

305

304

302

302

302

ELECTRONIC CIGARETTE, BATTERY ROD AND ATOMIZER

CROSS-REFERENCE TO RELATED APPLICATION

This application is a continuation application of International Patent Application No. PCT/CN2014/074543, by Qiuming LIU, filed Apr. 1, 2014, which is hereby incorporated herein in its entirety by reference.

TECHNICAL FIELD

The present invention relates to the field of electronic heating products, more specifically, relates to an electronic cigarette, a battery rod and an atomizer.

BACKGROUND

An electronic cigarette generally comprises an atomizer and a battery rod. In prior art, the atomizer and the battery rod of the electronic cigarette are generally connected to each other by a treaded connection. The physical connection and electronic connection between the atomizer and the battery rod are achieved by rotating the atomizer or the battery rod. When tobacco tar in the atomizer runs out, by rotating the atomizer in reverse, the atomizer can be taken out and can subsequently be replaced by a new atomizer.

Referring to FIG. 1, a conventional electronic cigarette comprises a battery rod 1 and an atomizer 6. A first connecting element and a second connecting element 5 which are configured to connect the atomizer 6 to the battery rod 1 are provided at the junction between the atomizer 6 and the battery rod 1. The first connecting element includes a first external electrode 4 and a first internal electrode 3. Wherein the first internal electrode 3 is extending through the first external electrode 4, and is electrically insulated from the first external electrode 4. During the assembly process of connecting battery rod 1 to the atomizer 6, the second connecting element 5 is inserted into the first connecting element, and is rotated; and thus the second connecting element 5 is fastened to the first connecting element. However, the first internal electrode 3 of the conventional electronic cigarette usually consists of a first sub-internal electrode 31 in U shape, a spring 32 contained in the first sub-internal electrode 31, and a second sub-internal electrode 33. Wherein, the second sub-internal electrode 33 is mounted at the U-shaped opening of the sub-internal electrode 31 and abuts against the spring 32. The first sub-internal electrode 31 is movably connected to the second sub-internal electrode 33. When the first internal electrode 3 has this type of structure, the first-sub internal electrode 31 may be in poor contact with the second sub-internal electrode 33 during the connection. Thus, the first internal electrode 3 may produce larger and unstable resistance, and the current supplied power to the atomizer may be unstable. Therefore, the amount of smoke produced by the electronic cigarette may be unstable and smaller. In this way, the performance of the electronic cigarette will be influenced.

BRIEF SUMMARY

To solve the drawbacks that the first internal electrode of a conventional electronic cigarette is in poor contact, producing larger resistance and influencing the performance of the electronic cigarette, the present invention provides an electronic cigarette, a battery rod and an atomizer in stabilized contact, with low cost and convenient for assembly.

The technical solutions to solve the technical problems are as follows:

In one aspect, an electronic cigarette is provided in the disclosure. The electronic cigarette comprises an atomizer and a battery rod; wherein a first connecting element and a second connecting element configured to connect the atomizer to the battery rod are provided at the junction between the atomizer and the battery rod, wherein, the first connecting element includes a first external electrode, a first internal electrode formed in one piece, and an elastic element; the first internal electrode extends through the first external electrode and is electrically insulated from the first external electrode; the elastic element abuts against the first internal electrode and is configured to provide an elastic force that is oriented towards the second connecting element to the first internal electrode;

the elastic element is made from insulating material; a through-hole through which the first internal electrode extends is defined in the elastic element; and the elastic element is sleeved between the first external electrode and the first internal electrode;

a groove is defined on the peripheral face and/or end face of the elastic element, and is configured for the deformation of the elastic element.

In one embodiment, a plurality of grooves separated from each other at an equal interval are defined on the peripheral face and/or end face of the elastic element, and the plurality of grooves form a ring.

In this embodiment, the first internal electrode includes an electrode mast and a second flange arranged around the outer peripheral surface at one end of the electrode mast; the electrode mast extends through the through-hole of the elastic element; and one end of the elastic element abuts against the second flange.

Additionally, the first internal electrode further includes a fourth flange arranged around the outer peripheral surface at the other end of the electrode mast; wherein the fourth flange is configured to abut against the other end of the elastic element.

Besides, the first connecting element includes a fixed bracket; the fixed bracket is inserted between the first external electrode and the elastic element; a clamping ring configured to clamp the elastic element is formed on the internal peripheral face of the fixed bracket; wherein the external peripheral face of the elastic element elastically abuts against the clamping ring, and the internal peripheral face of the elastic element abuts against the external peripheral face of the first internal electrode.

Advantageously, the elastic element is in form of a cylinder; the elastic element includes a first elastic portion, a second elastic portion and a third elastic portion connected to each other successively; wherein the second elastic portion is formed at one end of the first elastic portion, and the diameter of the second elastic portion is smaller than that of the first elastic portion; while the third elastic portion is formed at the other end of the second elastic portion, and the diameter of the third elastic portion is larger than that of the second elastic portion;

the second elastic portion is clamped in the clamping ring in the radial direction; an end face of the third elastic portion and an end face of first elastic portion abut against the second flange and the fourth flange respectively.

Advantageously, the groove is defined on the end face and/or peripheral face of the first elastic portion.

In another embodiment, a clamping portion is arranged on the second connecting element; the external electrode is in form of a hollow cylinder; a stopping arm protrudes from an end face at one end of the fixed bracket that is oriented towards the second connecting element; wherein the stopping arm and the internal peripheral face of the first external electrode enclose together to form a clamping groove configured to clamp the clamping portion.

In this embodiment, the internal peripheral face of the first external electrode is recessed to form a guide channel that is extending through the whole internal peripheral face of the first external electrode; and the guide channel is connected to the clamping groove;

during the assembly process, the clamping portion is inserted into the first connecting element along the guide channel; when the clamping portion reaches to the junction between the clamping groove and the guide channel, the second connecting element is rotated, thus the clamping portion is screwed into the clamping groove so that the atomizer is connected to the battery rod by a plug connection.

Advantageously, the first connecting element further includes an elastic locating piece; the elastic locating piece is mounted on the internal peripheral face of the first external electrode, and is configured to stop the clamping portion positioned in the clamping groove.

Advantageously, a mounting hole is defined on the inner peripheral surface of the first external electrode; the mounting hole is located above the clamping groove; and the elastic locating piece is inserted in the mounting hole so as to stop the clamping portion 4034 in the clamping groove.

Advantageously, the elastic element is made from elastic rubber material.

In a further embodiment, a clamping portion is provided on the external peripheral face of the second connecting element; a butting groove is defined on an end face at one end of the first connecting element, and is configured to hold the second connecting element inserted; a clamping groove configured to clamp the clamping portion is defined on the inner wall of the butting groove, extending in the peripheral direction of the first connecting element; and a guide channel is defined on the inner wall of the butting groove, extending in the axial direction of the first connecting element; wherein the guide channel is connected to the clamping groove;

during assembly process, the clamping portion is inserted into the first connecting element along the guide channel, when the clamping portion reaches to the junction between the clamping groove and the guide channel, the second connecting element is rotated, thus the clamping portion is screwed into the clamping groove so that the atomizer is connected to the battery rod by a plug connection.

In this embodiment, the first connecting element further includes an elastic locating piece; the elastic locating piece is mounted on the internal peripheral face of the first connecting element, and is configured to stop the clamping portion positioned in the clamping groove.

In another aspect, a battery rod is also provided. The battery rod is configured to connect to an atomizer to form a electronic cigarette. Wherein the battery rod includes a battery sleeve, a battery contained in the battery sleeve, and a first connecting element configured to connect to the atomizer; wherein the first connecting element is arranged at one end of the battery sleeve that is oriented towards the atomizer, wherein, the first connecting element includes a first external electrode, a first internal electrode formed in one piece, and an elastic element; the first internal electrode extends through the first external electrode and is electrically insulated from the first external electrode; the an elastic element abuts against the first internal electrode and is configured to provide an elastic force that is oriented towards the second connecting element to the first internal electrode;

the elastic element is made from insulating material; a through-hole through which the first internal electrode extends is defined in the elastic element; and the elastic element is sleeved between the first external electrode and the first internal electrode;

a groove is defined on the peripheral face and/or end face of the elastic element, and is configured for the deformation of the elastic element.

In one embodiment, the first internal electrode includes an electrode mast, a second flange arranged around the outer peripheral surface at one end of the electrode mast, and a fourth flange arranged around the outer peripheral surface of the other end of the electrode mast;

the electrode mast extends through the through-hole of the elastic element;

the second flange and the fourth flange abut against the two ends of the elastic element respectively.

In another embodiment, a butting groove is defined on an end face at one end of the first connecting element; a clamping groove is defined on the inner wall of the butting groove, extending in the peripheral direction of the first connecting element; and a guide channel is defined on the inner wall of the butting groove, extending in the axial direction of the first connecting element; wherein the guide channel is connected to the clamping groove.

In a further embodiment, an atomizer is also provided. The atomizer is configured to connect to a battery rod to form a electronic cigarette. Wherein the atomizer includes an atomization sleeve, an atomization assembly contained in the atomization sleeve, and a first connecting element configured to connect to the battery rod; the first connecting element is arranged at one end of the battery sleeve that is oriented towards one end of the battery rod, wherein, the first connecting element includes a first external electrode, a first internal electrode formed in one piece, and an elastic element; the first internal electrode extends through the first external electrode and is electrically insulated from the first external electrode; the an elastic element abuts against the first internal electrode and is configured to provide an elastic force that is oriented towards the second connecting element to the first internal electrode;

the elastic element is made from insulating material; a through-hole through which the first internal electrode extends is defined in the elastic element; and the elastic element is sleeved between the first external electrode and the first internal electrode;

a groove is defined on the peripheral face and/or end face of the elastic element, and is configured for the deformation of the elastic element.

In one embodiment, the first internal electrode includes an electrode mast, a second flange arranged around the outer peripheral surface at one end of the electrode mast, and a fourth flange arranged around the outer peripheral surface of the other end of the electrode mast;

the electrode mast extends through the through-hole of the elastic element;

the second flange and the fourth flange abut against the two ends of the elastic element respectively.

In another embodiment, a butting groove is defined on an end face at one end of the first connecting element; a clamping groove is defined on the inner wall of the butting groove, extending in the peripheral direction of the first connecting element; and a guide channel is defined on the inner wall of the butting groove, extending in the axial direction of the first connecting element; wherein the guide channel is connected to the clamping groove.

When implementing the present invention, the following advantageous effects can be achieved: in present invention, a first internal electrode formed in one piece is provided, and the drawback in prior art that larger resistance may be produced by the detached first internal electrode due to the poor contact can be avoided. A non-metallic elastic element is also provided, which provides an elastic force that is oriented towards the battery rod or the atomizer to the first internal electrode. Thus, the battery rod and the atomizer may be fit better with each other when they are connected to each other. Besides, the electrode of the atomizer and that of the battery rod can keep in good contact with each other. Since the elastic element has a groove configured for the deformation of elastic element, so that the deformation space is enlarged, thereby the elastic property of the elastic element is improved. Additionally, a through-hole is defined in the elastic element and is configured for the first internal electrode to extend through, and the elastic element is sleeved between the first external electrode and the first internal electrode and is configured to make the first external electrode insulated from the first internal electrode. Thus the functions of providing an elastic force and isolating the external electrode from the internal electrode are achieved by the elastic element, without needing extra isolating components. Therefore, the cost is reduced. During the assembly process, the first internal 303 is sleeved in the elastic element 302, and the elastic element 302 is further sleeved in the first external electrode 301. In this way, the connecting structure is simple; besides, it is convenient for the assembly of the electronic cigarette, and thus the production efficiency can be improved.

BRIEF DESCRIPTION OF THE DRAWINGS

The present invention will be further described with reference to the accompanying drawings and embodiments in the following, in the accompanying drawings.

DETAILED DESCRIPTION OF THE PREFERRED EMBODIMENT

In present invention, a first internal electrode formed in one piece is provided, and the drawback in prior art that larger resistance may be produced by the detached first internal electrode due to the poor contact can be avoided. An elastic element is also provided, which provides an elastic force that is oriented towards the battery rod or the atomizer to the first internal electrode. Thus, the battery rod and the atomizer may be fit better with each other when they are connected to each other. Besides, the electrode of the atomizer and that of the battery rod can keep in good contact with each other.

Figure 1:
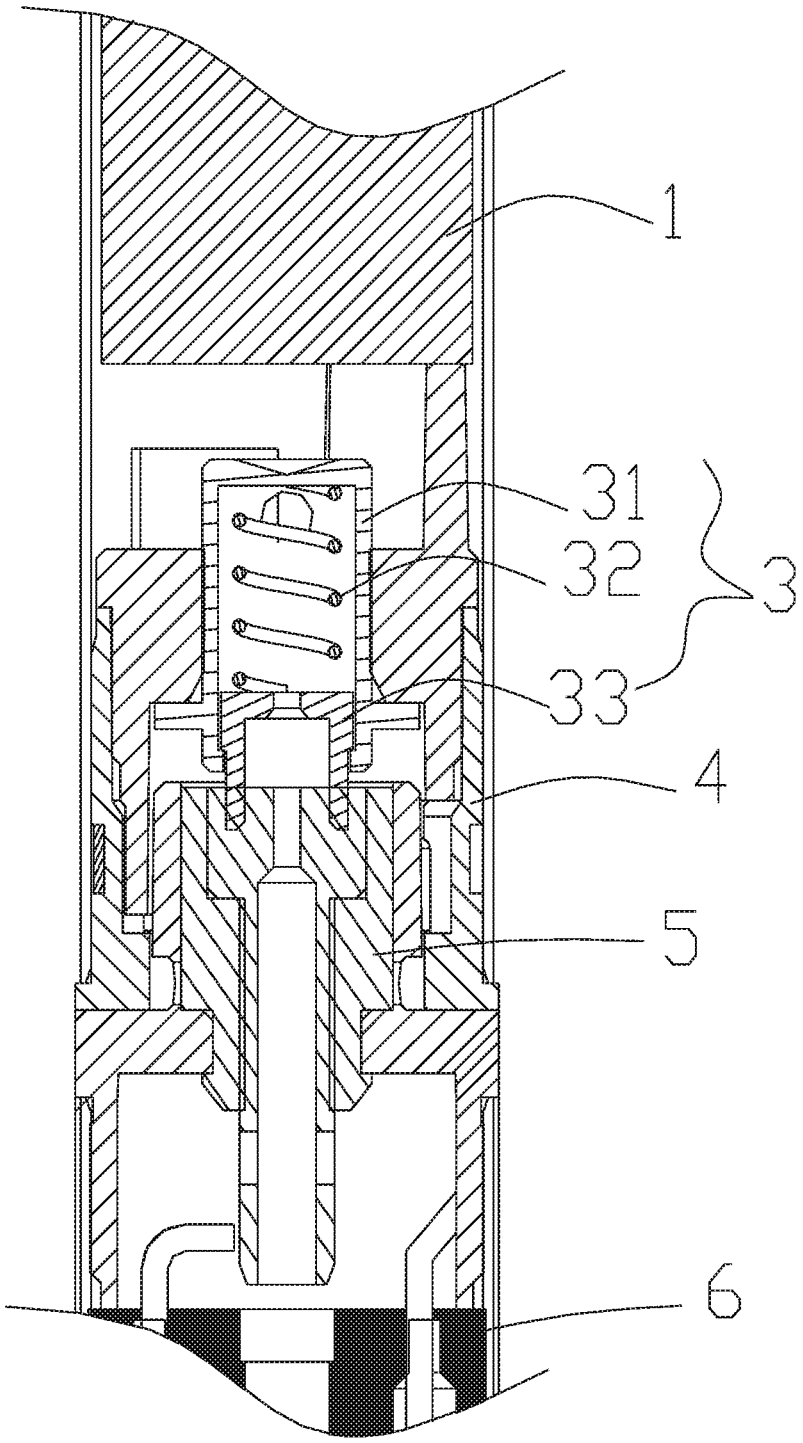
Figure 1(Prior Art)
FIG. 1 is a structural schematic view of a conventional electronic cigarette in the art.
Figure 2:
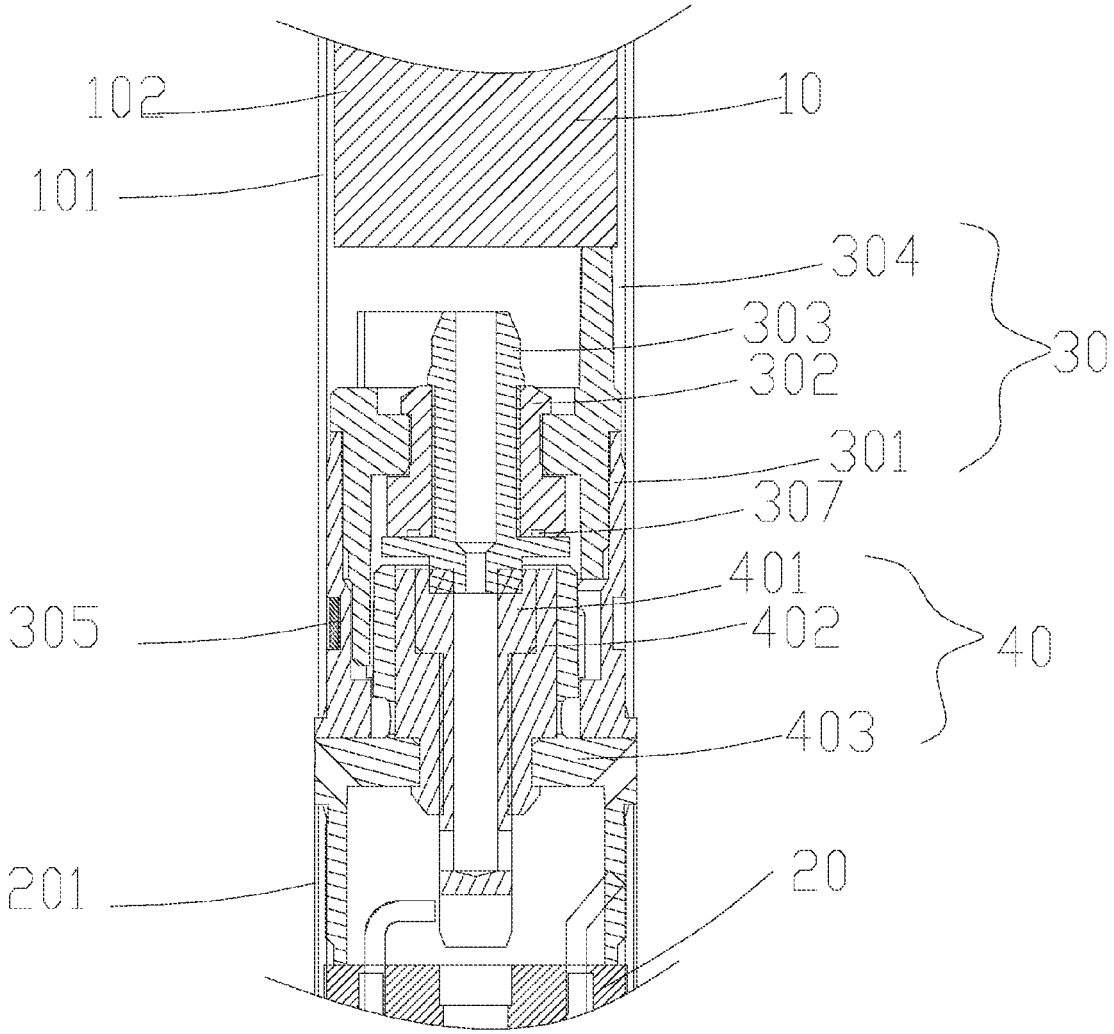
FIG. 2 is a partial cross-section view of an electronic cigarette according to the present invention.
Figure 3:
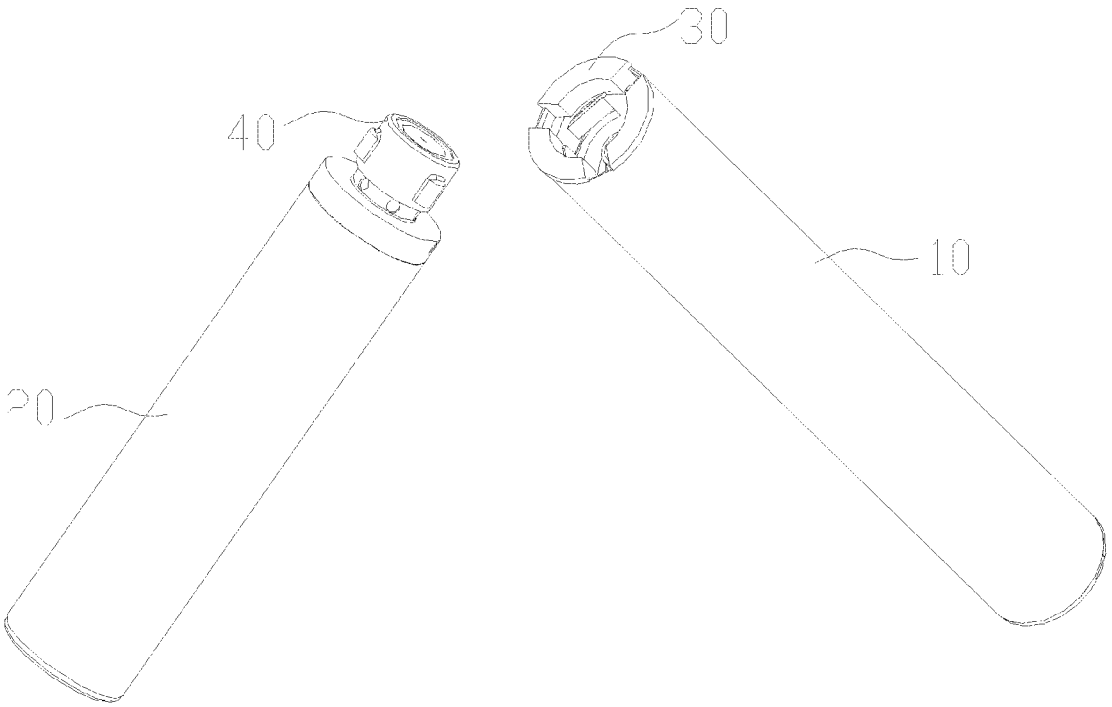
FIG. 3 is a stereogram of the electronic cigarette according to the present invention.

Referring to FIG. 2 and FIG. 3, in an embodiment of the present invention, an electronic cigarette comprises an atomizer 20 and a battery rod 10. A first connecting element 30 and a second connecting element 40 configured to connect the atomizer 20 to the battery rod 10 are provided at the junction between the atomizer 20 and the battery rod 10. The first connecting element 30 includes a first external electrode 301, a first internal electrode 303 and an elastic element 302. The first internal electrode 303 formed in one pieces extends through the first external electrode 301 and is electrically insulated from the first external electrode 301. The elastic element 302 abuts against the first internal electrode 303 and is configured to provide an elastic force which is oriented towards the second connecting element to the first internal electrode 303. One end of the first internal electrode 303 elastically abuts against the second connecting element 40, and the other end of the first internal electrode 303 is electrically connected to a battery 102 or an atomization assembly (not labeled) through wires.

Figure 12:
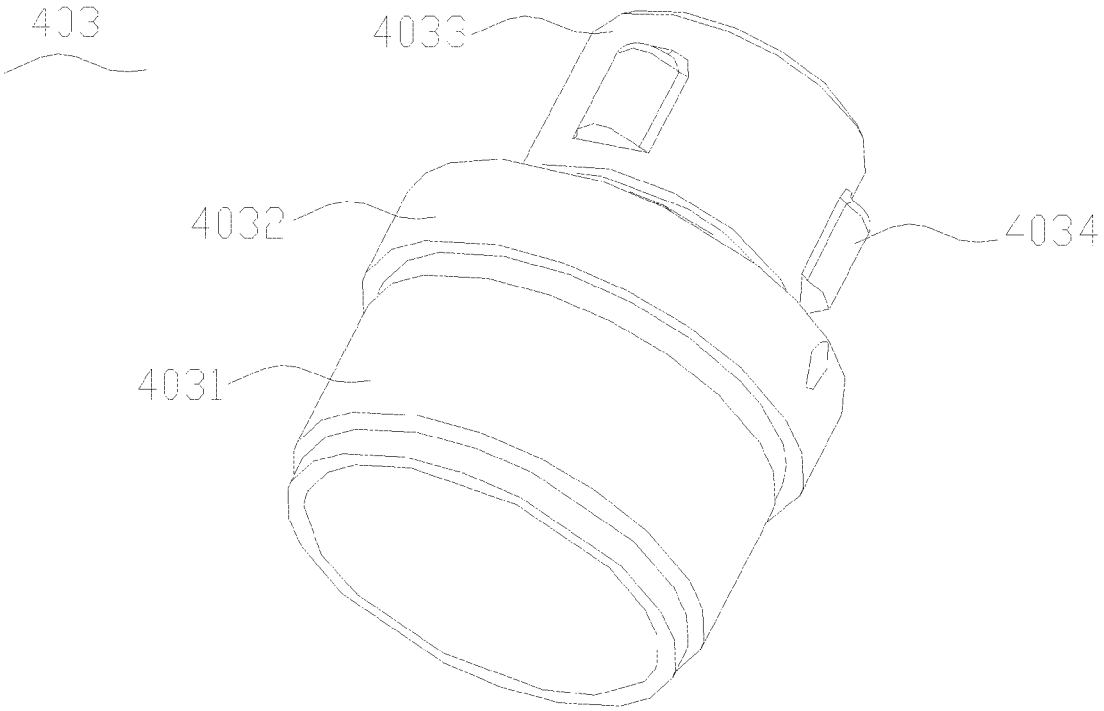
FIG. 12 is a stereogram of a first external electrode shown in FIG. 2.

Wherein, a clamping portion 4034 (referring to FIG. 12) is arranged on the external peripheral face of the second connecting element 40. A butting groove configured to hold the second connecting element 40 inserted is defined on an end face at one end of the first connecting element 30. A clamping groove 3012 (referring to FIG. 4) configured to clamp the clamping portion 4034 is defined on the inner wall of the butting groove, and is extending along the peripheral direction of the first connecting element 30. A guide channel 3011 (referring to FIG. 4) is also provided on the inner wall of the butting groove, and is extending along the axial direction of the first connecting element 30. The guide channel 3011 is further connected to the clamping groove 3012. During the assembly process, the clamping portion 4034 is inserted into the first connecting element 30 along the guide channel 3011. When the clamping portion 4034 reaches to the junction between the clamping groove 3012 and the guide channel 3011, the second connecting element 40 is rotated. In this way, the clamping portion 4034 can be screwed into the clamping groove 3012, and the atomizer 20 can be connected to the battery rod 10 by a plug connection.

In one embodiment, the first connecting element 30 is mounted on the battery rod 10, and the second connecting element 40 is mounted on the atomizer 20 accordingly. In specific, the atomizer 20 includes an atomization sleeve 201 and an atomization assembly contained in the atomization sleeve 201. The battery rod 10 includes a battery sleeve 101, a battery 102 contained in the battery sleeve 101, and the first connecting element 30; wherein the first connecting element 30 is arranged on an end portion at one end of the battery sleeve 101 that is oriented towards the atomizer 20.

The first connecting element 30 includes a first external electrode 301, an elastic element 302 extending through the first external electrode 301, a first internal electrode 303 extending through the first external electrode 301, and a fixed bracket 304 arranged between the first external electrode 301 and the elastic element 302. Wherein, the first external electrode 301 and the first internal electrode 303 are made from metal materials, and are conductive. The elastic element 302 is made from insulating materials. Therefore, the elastic element 302 can not only provide an elastic force, but also make the first external electrode 301 insulated from the first internal electrode 303. Additionally, the first internal 303 is sleeved in the elastic element 302, and the elastic element 302 is further sleeved in the first external electrode 301. In this way, the configuration of the electronic cigarette according to the present application is simple, and is convenient for assembly. Thereby, the production efficiency can be improved.

Figure 11:
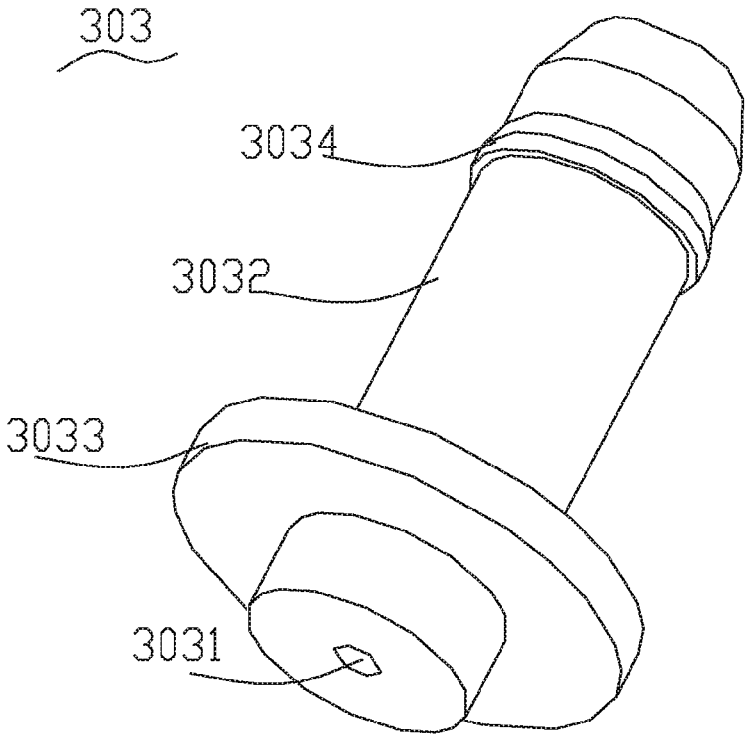
FIG. 11 is a stereogram of a first internal electrode shown in FIG. 2.

Referring to FIG. 2 and FIG. 11, the second connecting element 40 includes a second external electrode 403, a second internal electrode 401 extending through the second external electrode 403, and an insulating ring 402. The insulating ring 402 is sleeved between the second external electrode 403 and the second internal electrode 401, and is configured to make the second internal electrode 401 insulated from the second external electrode 403. When the atomizer 20 is connected to the battery rod 10, the second internal electrode 401 is elastically contacted with the first internal electrode 303; and the second external electrode 403 is inserted into the first external electrode 301. Thus the atomizer 20 is electronically connected to the battery rod 10, which make the electronic cigarette start to work. In specific, the second external electrode 403 is substantially in form of a hollow cylinder. The second external electrode 403 includes a second external electrode connecting portion 4031 configured to be connected to the atomization sleeve 201, and a second external electrode receiving portion 4033 configured to connect to the first connecting element 30. A third flange 4032 protrudes from the external surface at one end of the second external electrode connecting portion 4031 that is closed to the second external electrode receiving portion 4033 along the circumference direction of the second external electrode connecting portion 4031. The third flange 4032 is clamped at the orifice of the atomization sleeve 201. The second external electrode connecting portion 4031 is contained in the atomization sleeve 201, and is permanently connected to the atomization sleeve 201 by an interference fit. The second external electrode receiving portion 4033 is extending outwards to the outside of the atomization sleeve 201. The clamping portion 4034 protrudes outwards from one end of the second external electrode receiving portion 4033 that is closed to the first connecting element 30 along the radial direction of the second external electrode receiving portion 4033. The clamping portion 4034 is configured to clamp the first connecting element 30, and is positioned on the outer peripheral face of the second connecting element 40. In the present embodiment, three clamping portions 4034 in form of convexes are provided. Wherein, the three clamping portions 4034 are uniformly distributed on the second external electrode 403 in the circumference direction of the second external electrode 403. It can be understood that, the present application is not limit to the shape and the quantity of the clamping portions provided here.

Figure 4:
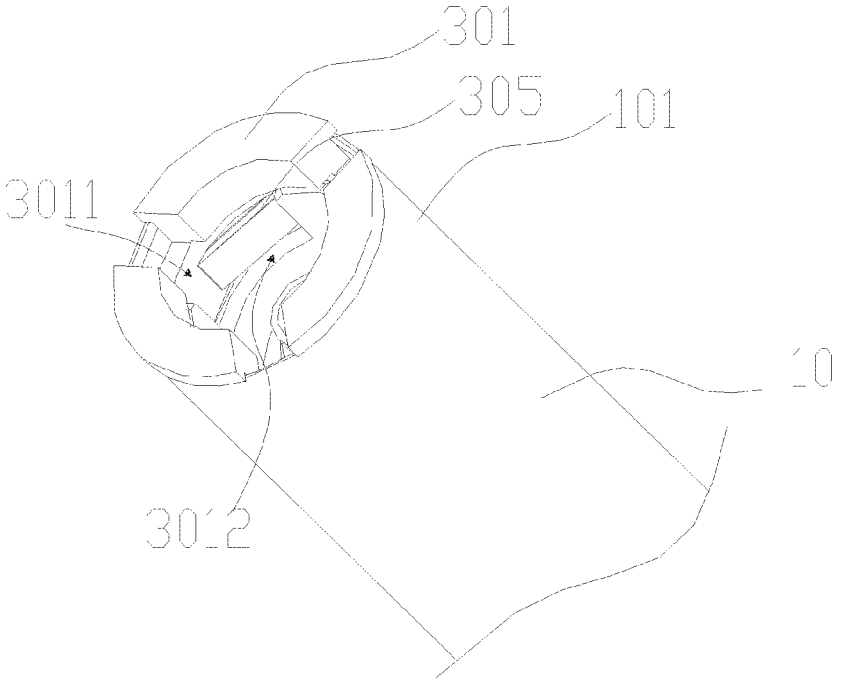
FIG. 4 is a structural schematic view of a battery rod shown in FIG. 3.
Figure 5:
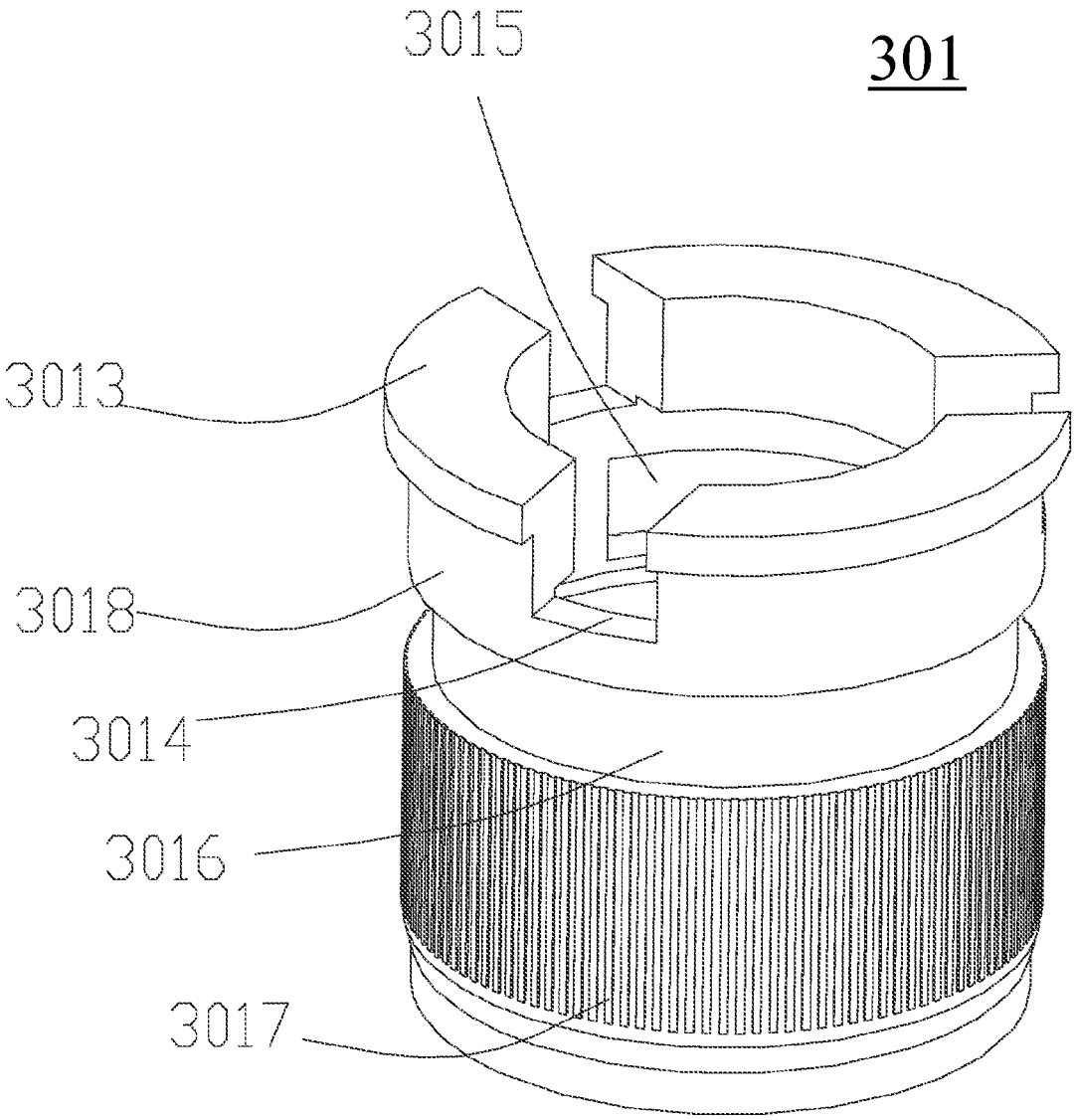
FIG. 5 is a stereogram of a first external electrode shown in FIG. 2.
Figure 6:
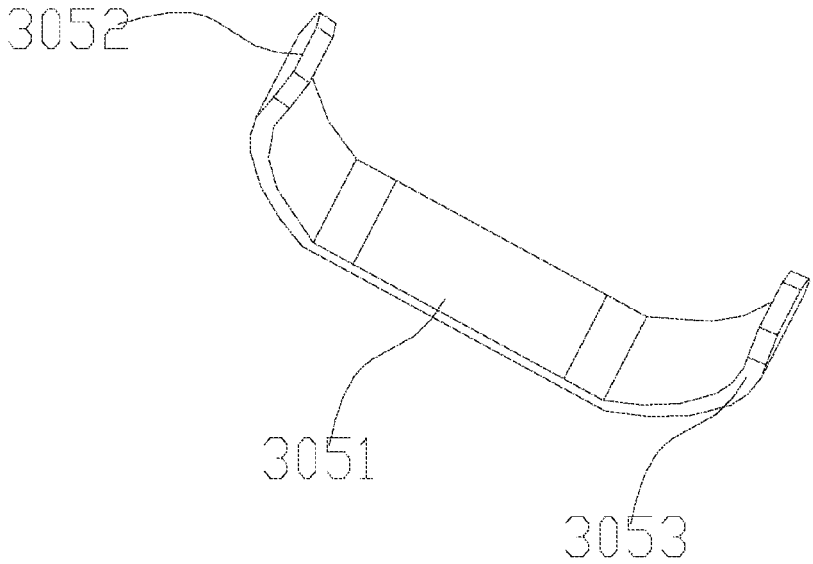
FIG. 6 is a structural schematic view of an elastic locating piece shown in FIG. 2.

Referring to FIG. 4, FIG. 5 and FIG. 2, the first external electrode 301 is substantially in form of a hollow cylinder. Wherein the first external electrode 301 includes a first external electrode receiving portion 3018 configured to hold the second connecting element 30 inserted, a first external electrode connecting portion 3017 configured to connect to the battery sleeve 101, and a transition portion 3016 connected between the first external electrode receiving portion 3018 and the first external electrode connecting portion 3017. A first flange 3013 protrudes outwards from the end portion at one end of the first external electrode receiving portion 3018 that is oriented towards the second connecting element 40 in the circumference direction of the first external electrode 301. The first flange 3013 is clamped at the orifice of the battery sleeve 101. The first external electrode receiving portion 3018, the transition portion 3016 and the first external electrode connecting portion 3017 are all contained in the battery sleeve 101. The first external electrode receiving portion 3018 and the transition portion 3016 are permanently connected to the battery sleeve 101 by an interference fit between the first external electrode connecting portion 3017 and the battery sleeve 101. In the present embodiment, the hollow cylinder of the first external electrode receiving portion 3018, the end portion of the first internal electrode 303 and one end of the fixed bracket 304 are enclosed together to form the butting groove (not labeled) which is configured to hold the second connecting element 40 inserted. Both the shape and the dimension of the butting groove match with the shape and the dimension of the clamping portion 4034. That is, the butting groove is configured to hold the clamping portion 4034 of the second connecting element 40 contained. A notch 3014 matching with the clamping portion 4034 of the second external electrode 403 is defined on the first external electrode receiving portion 3018. The notch 3014 is extending from the end portion at one end of the first external electrode receiving portion 3018 that is closed to the second connecting element 40 along the axial direction thereof in a direction that is far away from the end portion. The internal peripheral face of the first external electrode 301 is recessed from the end of the notch 3014 to form the guide channel 3011 that is extending through the internal peripheral face of the first external electrode 301. The guide channel 3011 is configured to guide the clamping portion 4034 of the second external electrode 403 to enter into the first external electrode 301. In this way, the atomizer 20 can be connected to the battery rod 10 by a plug connection.

Figure 7:
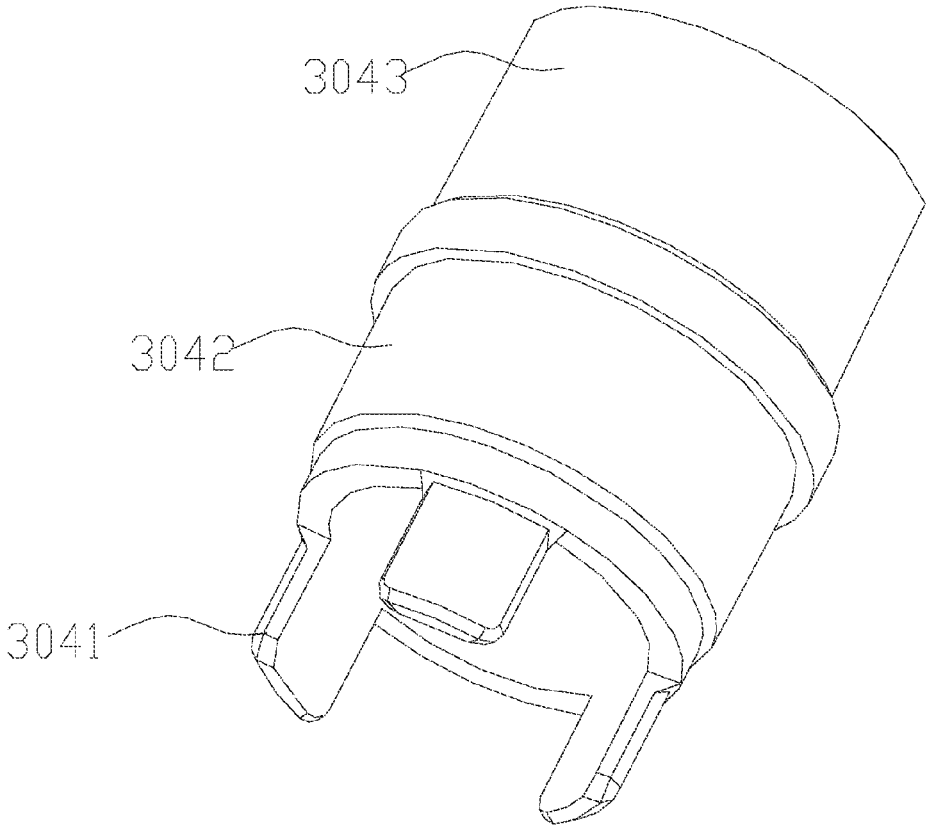
FIG. 7 is a stereogram of a fixed bracket shown in FIG. 2.

Referring to FIG. 4 and FIG. 7, the fixed bracket 304 is substantially in form of a hollow cylinder. Wherein, the fixed bracket 304 includes a first bracket connecting portion 3042, a second bracket connecting portion 3043, and a clamping ring (not labeled) protruding inwards along the internal peripheral face of the fixed bracket 304. A stopping arm 3041 protrudes from an end face at one end of the first bracket connecting portion 3042 that is oriented towards the second connecting element 40. The number of the stopping arms 3041 is equal to the number of the clamping portions 4034. The stopping arm 3041 and the internal peripheral face of the first external electrode 301 enclose together to form a clamping groove 3012 which is configured to clamp the clamping element 4034 of the second connecting element 40. The clamping groove 3012 is communicated with the guide channel 3011. During the assembly process, the clamping portion 4034 is inserted into the first connecting element 30 along the guide channel 3011. When the clamping portion 4034 reaches to the junction between the clamping groove 3012 and the guide channel 3011, the second connecting element 40 is rotated, so that the clamping portion 4034 can be screwed into the clamping groove 3012. In this way, the atomizer 20 can be connected to the battery rod 10 by a plug connection. As a result, the structure of the electronic cigarette is simplified, and the connection between the atomizer 20 and the battery rod 10 is facilitated.

Referring to FIG. 2, and FIGS. 4-6, in order to prevent the clamping portion 4034 clamped in the clamping groove 3012 from sliding out, an elastic locating piece 305 is provided on the first connecting element 30. The elastic locating piece 305 is substantially in form of an arch formed by bending an elastic sheet. Wherein, the elastic locating piece 305 includes a stopping portion 3051 and installation portions 3052 and 3053. The middle of the stopping portion 3051 is protruded. The installation portions 3052 and 3053 are respectively connected to the two ends of the stopping portion 3051. The elastic locating piece 305 is fixed on the internal peripheral face of the first external electrode 301 by the installation portion 3052 and the installation portion 3053, and the stopping portion 3051 is clamped with the end portion of the clamping portion 4034. In this way, the clamping portion 4034 clamped in the clamping groove 3012 can be prevented from sliding out of the clamping groove 3012. By using the elastic locating piece, only the elastic locating piece 305 needs to be pressed when the clamping portion 4034 is sliding out. In this way, it is simply and easily to operate the electronic cigarette. In the present invention, a mounting hole 3015 is defined on the inner peripheral surface of the transition portion 3016 of the first external electrode 301. The mounting hole 3015 is configured to hold the elastic locating piece 305 mounted in. In specific, the installation portions 3052 and 3053 of the elastic locating piece 305 are inserted in the mounting hole 3015; while the stopping portion 3051 protrudes toward the centre line of the first connecting element 30, so that the stopping portion 3051 is clamped with the end portion of the clamping portion 4034.

Figure 8:
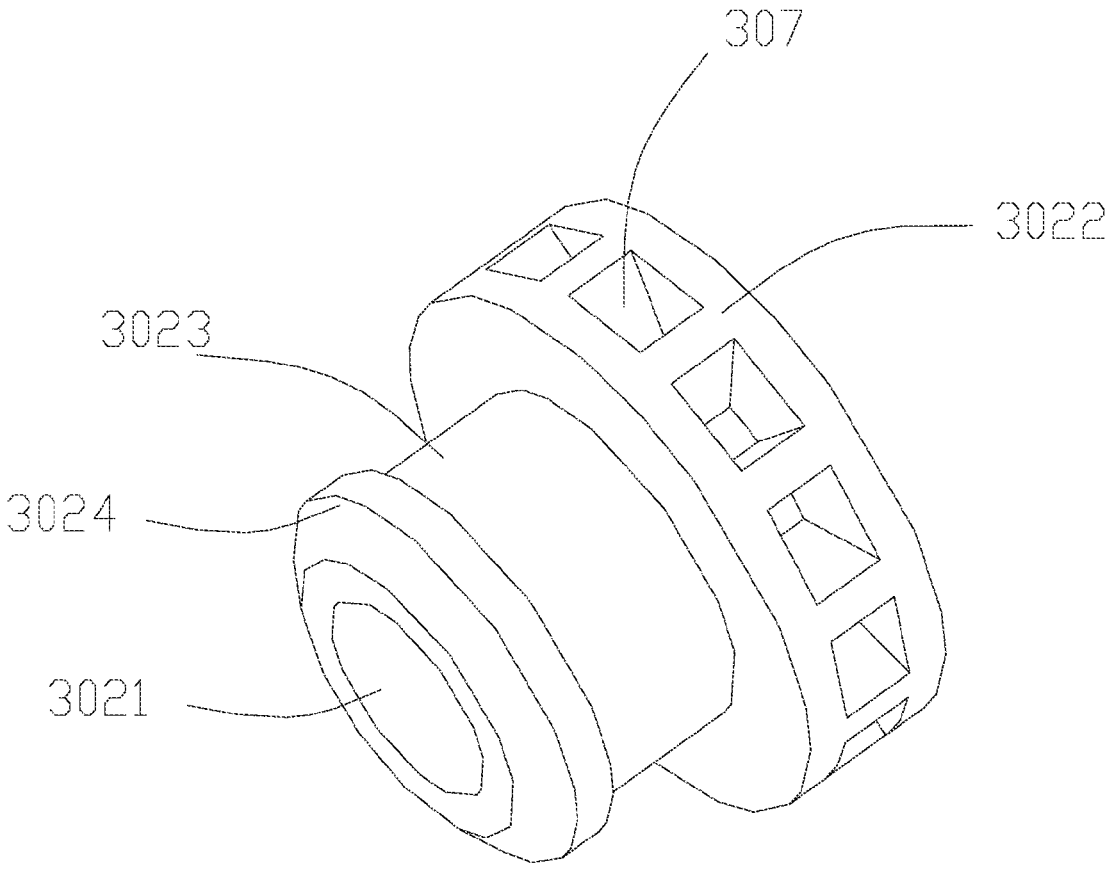
FIG. 8 is a schematic view showing a first embodiment of an elastic element shown in FIG. 2.

Referring to FIG. 2 and FIG. 8, the elastic element 302 is in form of a cylinder. The elastic element 302 includes a first elastic portion 3022, a second elastic portion 3023 and a third elastic portion 3024. Wherein the first elastic portion 3022 is formed at one end of the first elastic portion 3022, and the diameter of the second elastic portion 3023 is smaller than that of the first elastic portion 3022; while the third elastic portion 3024 is formed at the other end of the second elastic portion 3023; and the diameter of the third elastic portion 3024 is larger than that of the second elastic portion 3023. A through-hole 3021 through which the first internal electrode 303 extends is defined in the center of the elastic element 302 along the axial direction thereof. The internal peripheral face of the elastic element 302 elastically abuts against the outer peripheral face of the first internal electrode 303. The diameters of the first elastic portion 3022 and of the third elastic portion 3024 are both larger than the diameter of the second elastic portion 3023. When the elastic element 302 is inserted in the fixed bracket 304, the second elastic portion 3023 is inserted in the clamping ring of the fixed bracket 304, and the outer peripheral face of the second elastic portion 3023 elastically abuts against the internal peripheral face of the clamping ring in the radial direction. The end face of the first elastic portion 3022 that is in the axial direction abuts against one end of the first internal electrode 303; and the end face of the third elastic portion 3024 that is in the axial direction abuts against another end of the first internal electrode 303. Due to the adoption of the structure, the elastic element 302 can provide a stable elastic force which is oriented towards the second connecting element 40 to the first internal electrode 303. During the assembly process, the first internal electrode 303 can keep in good contact with the second internal electrode 401. In the present embodiment, the elastic element 302 is made from insulating materials, such as elastic rubber or elastic plastic. Thus, the elastic element 302 can be used as an insulating ring; in this way, it can dispense with assembling an insulating ring between the first external electrode 301 and the first internal electrode 303. Thereby, the materials for manufacturing the insulating ring are saved, and the manufacturing cost is reduced.

Figure 9:
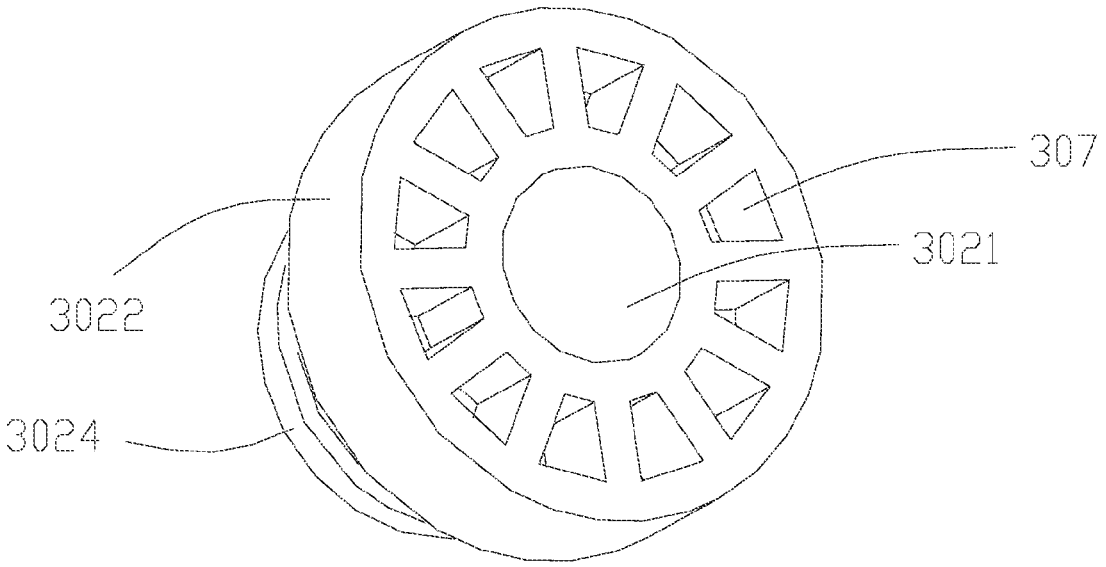
FIG. 9 is a schematic view showing a second embodiment of an elastic element shown in FIG. 2.
Figure 10:
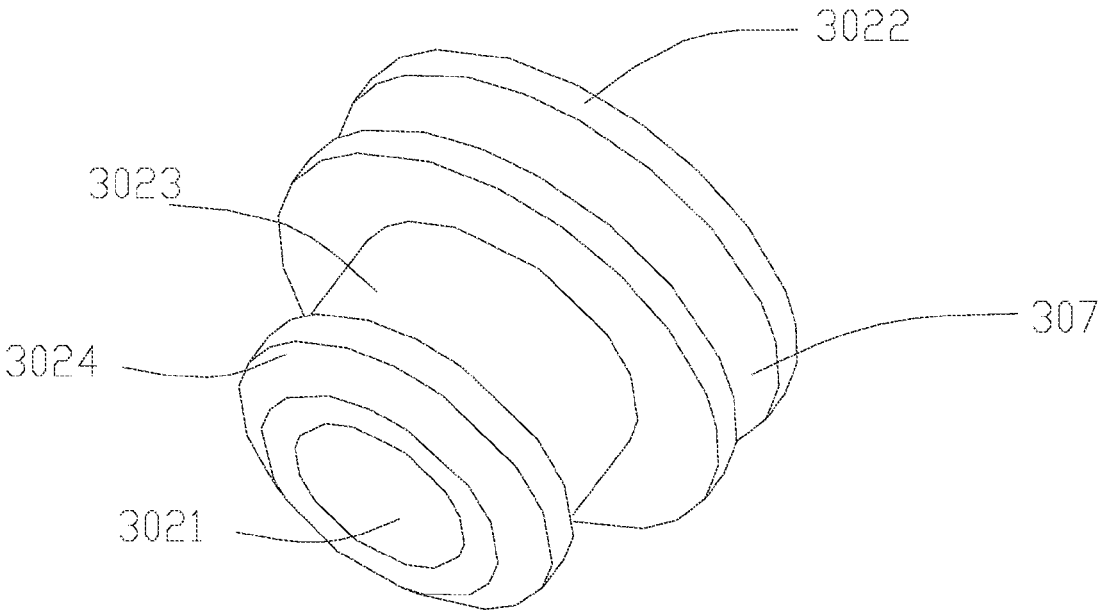
FIG. 10 is a schematic view showing a third embodiment of an elastic element shown in FIG. 2.

Referring to FIGS. 8-10, in the embodiment, a groove 307 is defined on the peripheral face and/or end face of the elastic element 302; wherein the groove 307 is configured for the elastic deformation of the elastic element 302. In specific, the groove 307 is defined on the end face of the first elastic portion 3022 (as shown in FIG. 9), or the groove 307 is defined on the peripheral face of the first elastic portion 3022 (as shown in FIG. 8 and FIG. 10). The groove 307 can be a plurality of blind holes extending along the axial direction or the radial direction of the elastic element 302. The plurality of grooves 307 are separated from each other at an equal interval; besides, the plurality of grooves 307 cooperate together to form a ring. Alternatively, the groove 307 can also be an annular groove formed on the peripheral face. It should be understood that, the groove 307 can be defined on the peripheral face and the end face of the first elastic portion 3022. The advantages of using this structure lie in that: by defining the grooves on the peripheral face or the end face of the elastic element 302, the elastic property of the elastic element 302 can be improved, and a stable elastic force can be provided; besides, the structure is compact and the cost of the elastic element 302 is lower than that of the spring. The grooves are separated from each other at an equal interval, in this way, the entire elastic element 302 is equally forced, and bigger elastic deformation space can be provided.

Referring to FIG. 2 and FIG. 10, the first internal electrode 303 is formed in one piece; wherein the first internal electrode 303 includes an electrode mast 3032, a second flange 3033 and a forth flange 3034. The second flange 3033 is formed by protruding outwards from the outer surface at one end of the electrode mast 3032 in the circumference direction thereof. The fourth flange 3034 is formed by protruding from the outer peripheral face at the other end of the electrode mast 3032. A breathing hole 3031 is defined in the center of the electrode mast 3032 in the axial direction thereof. The breathing hole 3031 is configured to supply air to the atomizer 10. The electrode mast 3032 extends through the through-hole 3021, the second flange 3033 is clamped at the orifice of one end of the through-hole 3021, and the fourth flange 3034 is clamped at the orifice of the other end of the through-hole 3021. That is, the second flange 3032 and the fourth flange 3034 are clamped at the two ends of the elastic element 302 respectively. From this, the third elastic portion 3024 of the elastic element 302 and the two end faces of the first elastic portion 3022 abut against the second flange 3033 and the fourth flange 3034 respectively. The first internal electrode 303 is firmly clamped in the elastic element 302 through the second flange 3033 and the fourth flange 3034. Wherein, the diameter of the fourth flange 3034 is smaller than the diameter of the second flange 3033. Thus, the first internal electrode 303 can be firmly contacted with the elastic element 302; in this way, the first internal electrode 303 can be provided with a stable elastic force provided by the elastic element 302. In this embodiment, the stable elastic force is oriented towards the second connecting element 40. Therefore, the first electrode 303 can be prevented from swinging from left to right, and the stabilization of the electronic cigarette is improved greatly. As the first internal electrode 303 is formed in one piece, that is, the first internal electrode 303 is a non-detachable component; larger resistance produced by the first internal electrode due to the poor contact can be avoided. The quality and the performance of the electronic cigarette can be improved.

Another embodiment of the electronic cigarette is provided in the present invention. The distinction between this embodiment and the above embodiment is that, the structure of the elastic element 302 in this embodiment is different from that one in the embodiment mentioned above. In this embodiment, the elastic element 302 is an elastic ring. The elastic ring is sleeved on the outside of the first internal electrode 301, and two ends of the elastic ring respectively abut against the second flange 3033 of the first internal electrode 301 and the clamping ring of the fixed bracket 304. In this way, the elastic element 302 can provide a stable elastic force provided by the elastic element 302 to the first internal electrode 303; wherein the elastic force is oriented towards the second connecting element 40. And thus, the second internal electrode 401 can keep in good contact with the first internal electrode 303 during the assembly process. In the embodiment, the first internal electrode 303 is electrically insulated from the first external electrode 301 by arranging an insulating part or a gap between the first internal electrode 301 and the fixed bracket 304, or between the first internal electrode 301 and the first external electrode 301. In other embodiments, in order to improve the elastic deformation ability, a plurality of blind holes separated from each other are defined on the outer peripheral face of the elastic element 302.

A third embodiment of the electronic cigarette is also provided in the present invention. Wherein, the distinctions between the electronic cigarette in the third embodiment and the electronic cigarette in the first embodiment include: in the third embodiment, the first connecting element 30 is mounted in the atomizer 20, while the second connecting element 40 is mounted in the battery rod 10. The specific structure and assembly relation are the same as those in the first embodiment, and will not be described in detail any more here.

The assembly principle of the electronic cigarette will be described in detailed below.

During the assembly process, when the battery rod 10 is connected to the atomizer 20, the clamping portion 4034 of the second connecting element 40 is aligned with the notch 3014 of the first connecting element 30, and is further inserted into the notch 3014 of the first connecting element 30. The clamping portion 4034 is inserted deeper along the guide channel 3011 of the first connecting element 30. When the clamping portion 4034 reaches to the junction between the clamping groove 3012 and the guide channel 3011, the second connecting element 40 is rotated, so that the clamping portion 4034 is screwed into the clamping groove 3012. At this time, the upper end face of the clamping portion 4034 is clamped with the stopping portion 3051 of the elastic locating piece 305; and the second internal electrode 401 of the second connecting element 40 pushes the first internal electrode 303 to move downwards. Thus, the elastic element 302 is compressed, producing an elastic deformation. In this way, the elastic element 302 provides an elastic force that is oriented towards the second internal electrode 401 to the first internal electrode 303. Therefore, the second internal electrode 401 can keep in good contacted with the first internal electrode 303. The second internal electrode 401 is therefore connected to the first internal electrode 303 by a plug connection. In the present invention, since the electronic cigarette is formed in one piece, larger resistance produced by the first internal electrode due to the poor contact can be avoided. At the same time, since the elastic element clamped with the first internal electrode provides an elastic force that is oriented towards the second connecting element, it can ensure that the first internal electrode is stably contacted with the second internal electrode, and the contact resistance is small. Thereby, the first internal electrode in the electronic cigarette according to the present application will not produce large resistance. Additionally, the performance of the electronic cigarette will not be greatly influenced.

While the present invention has been described with reference to preferred embodiments, however, the present invention is not limited to above-mentioned embodiments, those modifications, improvements and equivalent substitutions, which don't depart from the scope of the spirit and the principle of the present invention, should be included within the scope of the present invention.

What is claimed is:

1. An electronic cigarette, comprising an atomizer and a battery rod; wherein a first connecting element and a second connecting element configured to connect the atomizer to the battery rod are provided at a junction between the atomizer and the battery rod, wherein, the first connecting element includes a first external electrode, a first internal electrode formed in one piece, and an elastic element; the first internal electrode extends through the first external electrode and is electrically insulated from the first external electrode; the elastic element abuts against the first internal electrode and is configured to provide an elastic force that is oriented towards the second connecting element to the first internal electrode;

the elastic element is made from insulating material; a through-hole through which the first internal electrode extends is defined in the elastic element; and the elastic element is sleeved between the first external electrode and the first internal electrode;

wherein the first internal electrode includes an electrode mast, a second flange arranged around an outer peripheral surface at one end of the electrode mast and a fourth flange arranged around an outer peripheral surface at the other end of the electrode mast; the electrode mast extends through a through-hole of the elastic element; one end of the elastic element abuts against the second flange and the other end of the elastic element abuts against the fourth flange;

wherein a diameter of the fourth flange is smaller than a diameter of the second flange;

wherein the first connecting element includes a fixed bracket; the fixed bracket is inserted between the first external electrode and the elastic element; a clamping ring configured to clamp the elastic element is formed on an internal peripheral face of the fixed bracket; wherein an external peripheral face of the elastic element elastically abuts against the clamping ring, and an internal peripheral face of the elastic element abuts against an external peripheral face of the first internal electrode;

wherein the elastic element is in form of a cylinder; the elastic element includes a first elastic portion, a second elastic portion and a third elastic portion connected to each other successively; wherein the second elastic portion is formed at one end of the first elastic portion, and a diameter of the second elastic portion is smaller than that of the first elastic portion; while the third elastic portion is formed at the other end of the second elastic portion, and a diameter of the third elastic portion is larger than that of the second elastic portion;

the second elastic portion is clamped in the clamping ring in a radial direction; an end face of the third elastic portion and an end face of first elastic portion abut against the second flange and the fourth flange respectively; and wherein a plurality of grooves separated from each other at an equal interval are defined on a peripheral face and an end face of the first elastic portion, and are configured for deformation of the elastic element.

2. The electronic cigarette according to claim 1, wherein, the elastic element is made from elastic rubber material.

3. The electronic cigarette according to claim 1, wherein, several clamping portions are arranged on the second connecting element; the external electrode is in form of a hollow cylinder;

wherein the fixed bracket is substantially in form of a hollow cylinder and further includes a first bracket connecting portion and a second bracket connecting portion, several stopping arms protrude from an end face at one end of the first bracket connecting portion that is oriented towards the second connecting element, a number of the stopping arms is equal to a number of the clamping portions; wherein the stopping arms and an internal peripheral face of the first external electrode enclose together to form a clamping groove configured to clamp the clamping portion.

4. The electronic cigarette according to claim 3, wherein, the internal peripheral face of the first external electrode is recessed to form a guide channel that is extending through a whole internal peripheral face of the first external electrode; and the guide channel is connected to the clamping groove;

during the assembly process, the clamping portion is inserted into the first connecting element along the guide channel; when the clamping portion reaches to a junction between the clamping groove and the guide channel, the second connecting element is rotated, thus the clamping portion is screwed into the clamping groove so that the atomizer is connected to the battery rod by a plug connection.

5. The electronic cigarette according to claim 4, wherein, the first connecting element further includes an elastic locating piece; the elastic locating piece is mounted on the internal peripheral face of the first external electrode, and is configured to stop the clamping portion positioned in the clamping groove.

6. The electronic cigarette according to claim 5, wherein, a mounting hole is defined on the internal peripheral face of the first external electrode; the mounting hole is located above the clamping groove; and the elastic locating piece is inserted in the mounting hole so as to stop the clamping portion in the clamping groove.

* * * * *